US012089726B2

(12) United States Patent
Derr

(10) Patent No.: US 12,089,726 B2
(45) **Date of Patent: *Sep. 17, 2024**

(54) UNIVERSAL SECUREMENT STRAP FOR PERSONAL ITEMS

(71) Applicant: NITE IZE, INC., Boulder, CO (US)

(72) Inventor: Dedric Michal Derr, Oklahoma City, OK (US)

(73) Assignee: NITE IZE, INC., Boulder, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/353,788

(22) Filed: Jul. 17, 2023

(65) Prior Publication Data

US 2023/0389683 A1 Dec. 7, 2023

Related U.S. Application Data

(63) Continuation of application No. 17/816,961, filed on Aug. 2, 2022, now Pat. No. 11,737,552, which is a continuation of application No. 14/989,053, filed on Jan. 6, 2016, now Pat. No. 11,399,621.

(60) Provisional application No. 62/105,666, filed on Jan. 20, 2015.

(51) Int. Cl.
*A45F 5/00* (2006.01)

(52) U.S. Cl.
CPC ..... *A45F 5/00* (2013.01); *A45F 2005/006* (2013.01); *A45F 2200/0516* (2013.01)

(58) Field of Classification Search
CPC ..... A45F 3/14; A45F 2003/002; A45F 2005/008; A45F 2005/1013; A45F 5/00; A45F 2005/006; A45F 2200/0516; Y10T 24/1374; Y10T 24/3987; Y10T 24/3991; Y10T 24/1397

See application file for complete search history.

(56) References Cited

U.S. PATENT DOCUMENTS

| | | | | |
|---|---|---|---|---|
| 2,911,694 A | | 11/1959 | Seron | |
| 3,251,571 A | | 5/1966 | Ernest | |
| 4,322,077 A | * | 3/1982 | Van't Hof | A63B 49/08 224/220 |
| 4,570,577 A | | 2/1986 | Bellinger | |
| 5,896,623 A | * | 4/1999 | Martin | F16L 3/233 24/3.13 |
| D550,951 S | | 9/2007 | Belsky | |

(Continued)

*Primary Examiner* — Jack W Lavinder
(74) *Attorney, Agent, or Firm* — FisherBroyles, LLP; Craig W. Mueller

(57) ABSTRACT

An adjustable securement device which retains and secures items of personal property without slippage. The device includes an elastic band, an at least one sliding cinch, and a lanyard attachment mechanism. The elastic band is used to firmly secure and hold the item. The sliding cinch includes a constricting body and a strap-receiving hole. The strap-receiving hole traverses through the constricting body. The elastic band is slidably positioned within the strap-receiving hole to position the body of the elastic band adjacent to itself in order to create two separate loops. The first loop is positioned around the item and constricted tightly by sliding the sliding cinch adjacent to the item, thus securing and holding the item. The second loop is used to attach the lanyard attachment mechanism to the elastic band. The lanyard attachment mechanism is coupled to the elastic band and allows the device to attach to external structures.

17 Claims, 9 Drawing Sheets

(56) References Cited

U.S. PATENT DOCUMENTS

| | | | | |
|---|---|---|---|---|
| 9,038,248 | B1 | 5/2015 | Linn | |
| D751,284 | S | 3/2016 | Kishimoto | |
| 2005/0067549 | A1 | 3/2005 | Kintzele | |
| 2005/0283952 | A1 | 12/2005 | Talbot | |
| 2006/0272890 | A1* | 12/2006 | Harmon | A45F 5/021 182/3 |
| 2009/0151130 | A1* | 6/2009 | Stewart | B65D 63/1081 24/16 R |
| 2015/0375933 | A1 | 12/2015 | First | |

* cited by examiner

SECTION A-A

UNIVERSAL SECUREMENT STRAP FOR PERSONAL ITEMS

CROSS-REFERENCE TO RELATED APPLICATIONS

This application is a continuation of U.S. patent Ser. No. 17/816,961, filed Aug. 2, 2022, now U.S. Pat. No. 11,737,552, issued Aug. 29, 2023, which is a continuation of U.S. patent application Ser. No. 14/989,053, filed Jan. 6, 2016, now U.S. Pat. No. 11,399,621, issued Aug. 2, 2022, which claims the benefit of U.S. Provisional Application Ser. No. 62/105,666, filed Jan. 20, 2015. The entirety of each application is incorporated by reference herein.

FIELD OF THE INVENTION

The present invention relates generally to securement devices for personal items and the like. More specifically, the present invention is an easily and highly adjustable strap which can secure under tension a variety of items, for example a cell phone, for storage and transportation purposes.

BACKGROUND

Available cell phone holders are typically meant for a specific type of phone in order for the cell phone holder to properly grasp the cell phone. Typical cell phone holders are meant to be strapped around wrists or held by the hand of a user. However, in most cases, a cell phone is meant to be hung from a bag, backpack, belt loop and so on.

The present invention is a securement strap for items of personal property, in particular for cell phones. The present invention provides convenience that present day cell phone holders and other similar item holders do not. The present invention uses a silicone rubber strap in conjunction with a cinching mechanism in order to grip and hold various items. The strap also contains elastic properties, allowing for it to deform and be put under tension, thus significantly increasing the slippage resistance and securing its hold on the item. The present invention can be configured to hold a variety of different types of cell phones. Additionally, the present invention may hold other items as well, as longs as the item can fit within the strap. Attached to the strap is a lanyard attachment mechanism. The lanyard attachment mechanism allows the present invention to be attached to external structures such as key chains, backpacks, and handbags to name a few non-limiting examples.

DETAILED DESCRIPTION

All illustrations of the drawings are for the purpose of describing selected versions of the present invention and are not intended to limit the scope of the present invention.

The present invention is a universal securement strap for personal items. The present invention utilizes an elastic strap in conjunction with a cinching mechanism in order to create an engagement loop. As a result, the present invention may be adjusted to secure and hold a wide variety of items including, but not limited to, cell phones, keys, flashlights, hammers, scissors, lighters, towels, and electronic cigarettes. In general, the present invention may secure around and hold any item that may fit within the engagement loop; this includes items of varying size, shape, design, and material composition.

Figure 1:
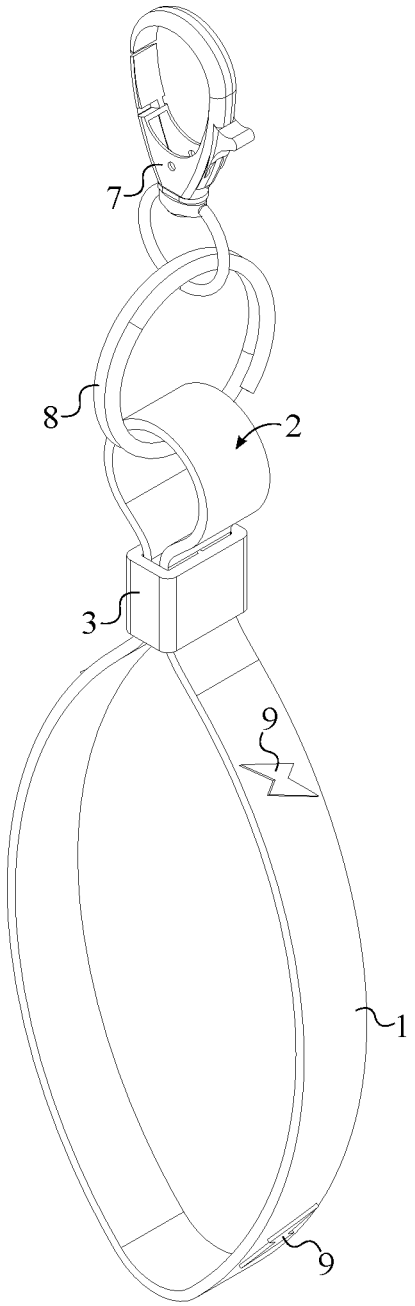
FIG. 1 is a perspective view of the present invention.
Figure 2:
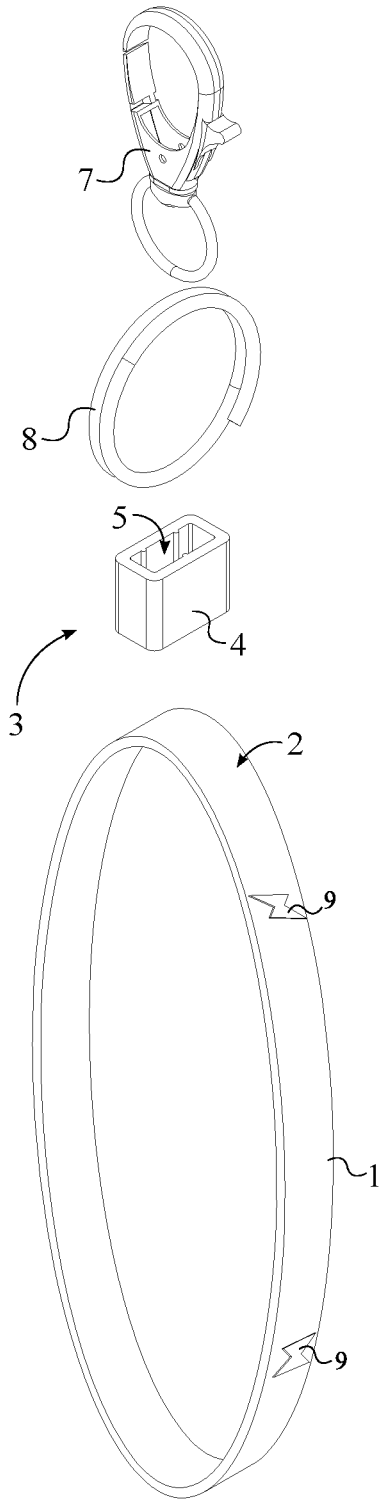
FIG. 2 is an exploded perspective view of the present invention.
Figure 3:
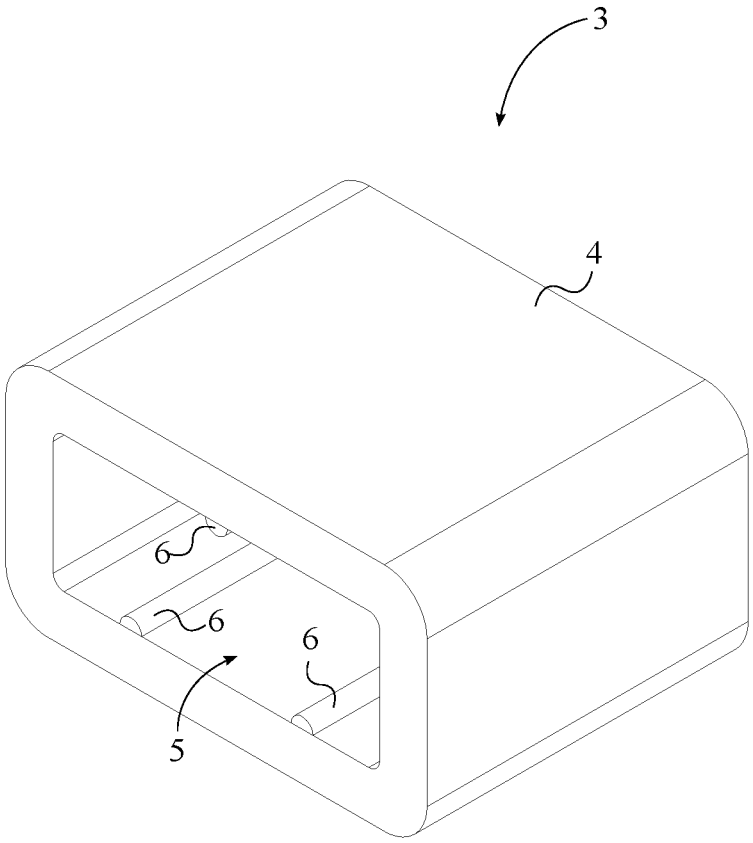
FIG. 3 is a perspective view of the sliding cinch component.
Figure 4:
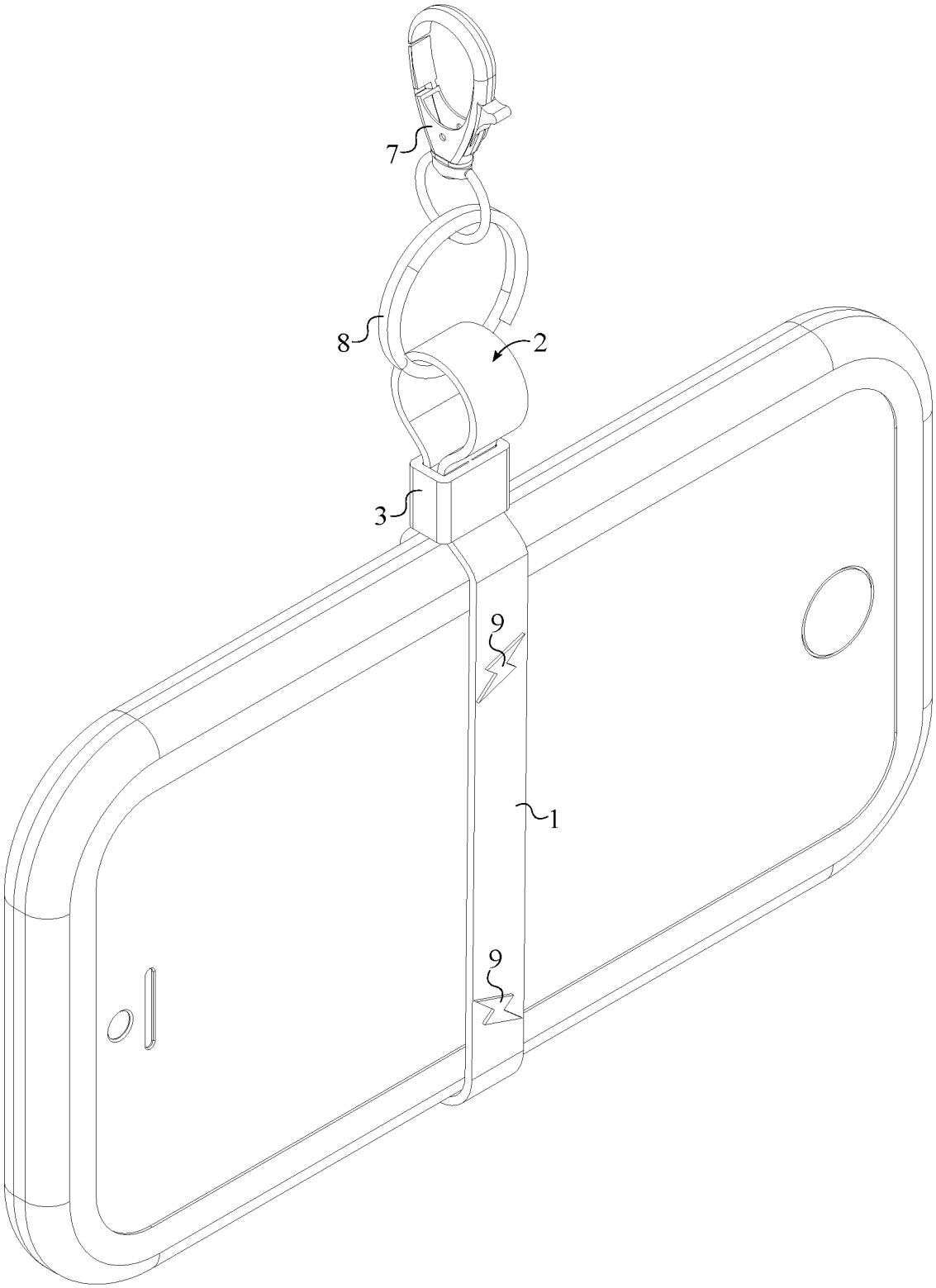
FIG. 4 is a perspective view of the present invention being looped around and securing a cell phone.

Referring to FIG. 1 and FIG. 2, the present invention comprises an elastic band 1, and at least one sliding cinch 3, and a lanyard attachment mechanism 7. The elastic band 1 is used to firmly secure the present invention to a personal item as seen in FIG. 4. This is achieved by positioning the elastic band 1 around the personal item under a tensioned state, thus constricting the elastic band 1 around the personal item in a firm, secure fashion. A variety of lengths and widths may be used for the elastic band 1 in order to allow for the securement of a wide array of items. The sliding cinch 3 wraps tightly around the elastic band 1 and aligns the body of the elastic band 1 adjacent to itself in order to create two separate loops. The first loop is used to secure/hold the personal item while the second loop is used to attach the lanyard attachment mechanism 7. The sliding cinch 3 comprises a constricting body 4 and a strap-receiving hole 5. The constricting body 4 is preferably a rectangular extrusion, although not limited to a rectangular shape, with a width that is marginally greater than a width of the elastic band 1, although alternative designs and shapes may also be utilized. The strap-receiving hole 5 is sized and shaped to the outer dimensions of the elastic band 1 and traverses through the constricting body 4 as seen in FIG. 3. The elastic band 1 is slidably positioned within the strap-receiving hole 5, thus providing the user the ability to control the sizing of the first loop and the second loop. More specifically, the elastic band 1 is pressed against the constricting body 4, inside the strap-receiving hole 5, which creates partial resistance for the sliding cinch 3 against easily translating along the length of the elastic band 1. This resistance prevents the sliding cinch 3 from moving relative to the elastic band 1 without the purposeful adjustment by the user. The lanyard attachment mechanism 7 provides a means of attaching the present invention to an external structure such as a loop, handle of a bag, a belt loop, or a backpack to name a few non-limiting examples. The lanyard attachment mechanism 7 is coupled to the elastic band 1 through the second loop.

In order to utilize the present invention, the user simply places the item which he or she would like to hold within the first loop of the elastic band 1 and constricts the elastic band 1 around the item by positioning the sliding cinch 3 directly adjacent to the item. This configuration puts the elastic band 1 in a tensioned state which in turn increases the present invention's grip on the item. One of the main applications for the present invention is to hold cell phones.

Figure 5:
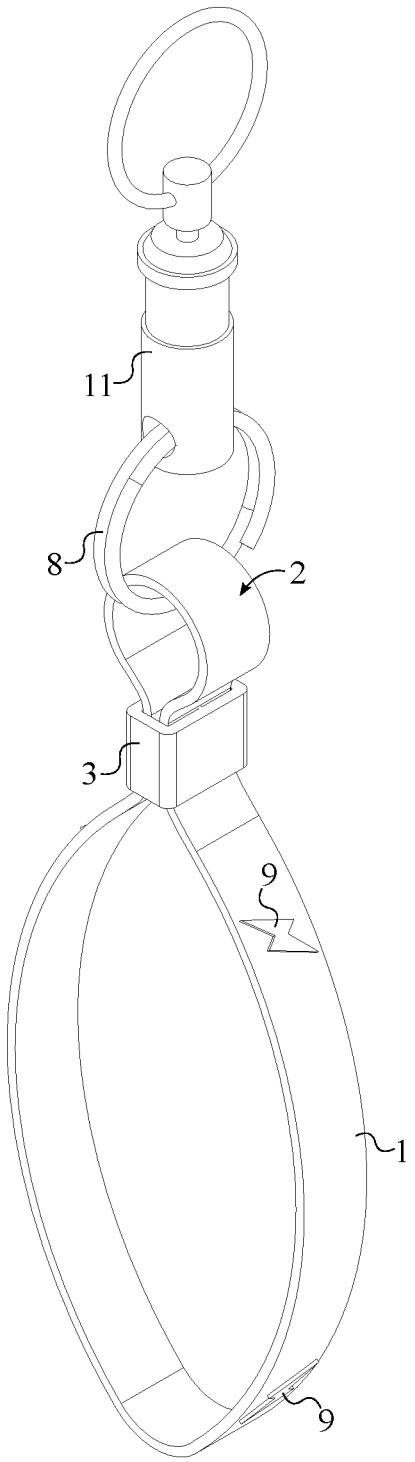
FIG. 5 is a perspective view of an alternative embodiment of the present invention, wherein the lanyard attachment mechanism is a quick-release key chain.
Figure 6:
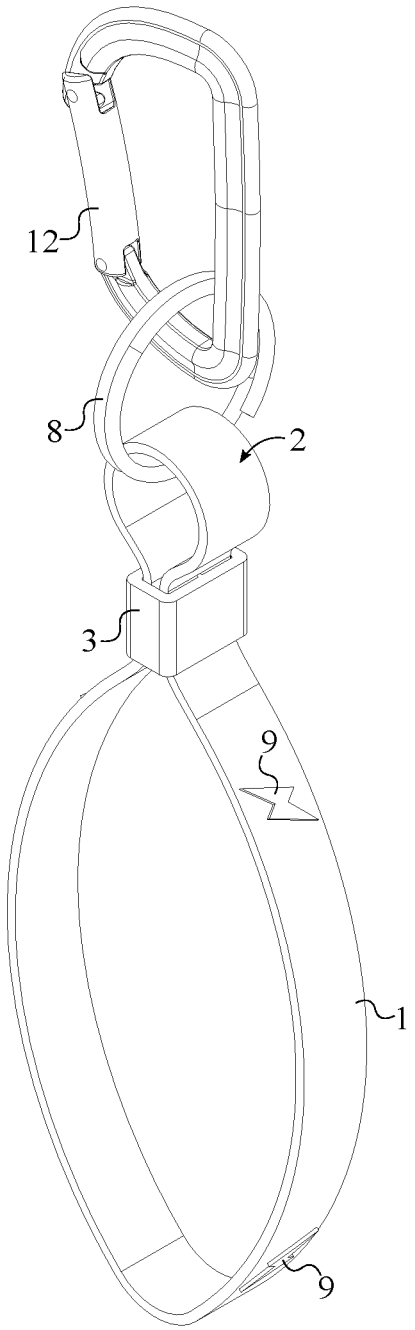
FIG. 6 is a perspective view of an alternative embodiment of the present invention, wherein the lanyard attachment mechanism is a carabiner.

A variety of devices may be used for the lanyard attachment mechanism 7 in order to provide the user with additional customization options. In one embodiment of the present invention, the lanyard attachment mechanism 7 is a crab claw 10, as seen in FIG. 1. In another embodiment of the present invention, the lanyard attachment mechanism 7 is a quick-release keychain holder 11, seen in FIG. 5, so the user can easily and quickly detach the present invention from the external structures. In yet another embodiment of the present invention, the lanyard attachment mechanism 7 is a carabiner 12, seen in FIG. 6, a common attachment mechanism. It is preferred that the lanyard attachment mechanism 7 is coupled to the elastic band 1 by a key ring 8, or other similar devices, as this offsets the lanyard attachment mechanism 7 from the elastic band 1, allowing the lanyard attachment mechanism 7 and the elastic band 1 to be used more easily than if connected directly to each other, although the key ring 8 is not required and the lanyard attachment mechanism 7 may be directly attached to the elastic band 1. More specifically, the elastic band 1 is looped through the key ring 8. Resultantly, the lanyard attachment mechanism 7 is coupled to the elastic band 1 by the key ring 8. The key ring 8 allows the user to attach additional items to the present invention through the use of the key ring 8. Different sized key rings 8 may be used for the present invention.

Figure 7:
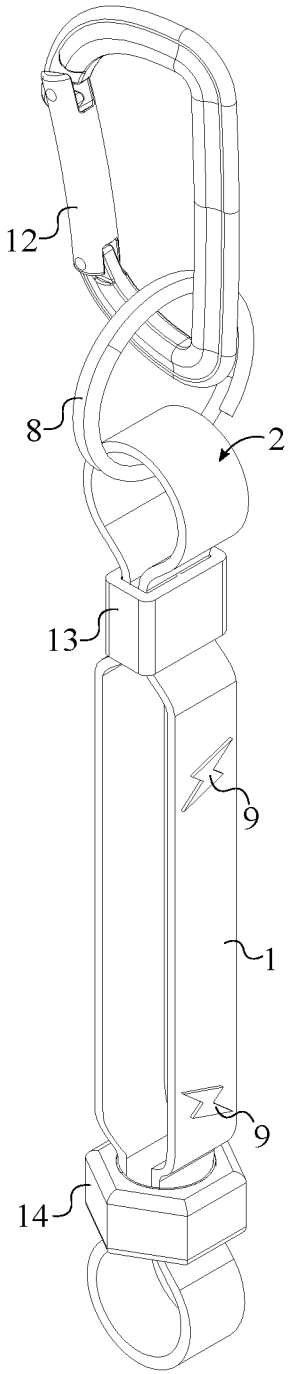
FIG. 7 is a perspective view of an alternative embodiment of the present invention, wherein the at least one sliding cinch comprises a first cinch and a second cinch.

In the preferred embodiment of the present invention, the at least one sliding cinch 3 further comprises a plurality of friction ribs 6. The plurality of friction ribs 6 press into and engage the elastic band 1 in order to prevent the sliding cinch 3 from freely or accidentally translating along the elastic band 1. This ensures that the present invention does not accidentally release the personal item, one of the many unique features of the present invention. Referring to FIG. 3, the plurality of friction ribs 6 is positioned within the strap-receiving hole 5 with each of the plurality of friction ribs 6 being adjacently connected to the constricting body 4. The preferred shape for each of the plurality of friction ribs 6 is a half-circular extrusion that spans the length of the constricting body 4, although alternative shapes and designs may also be utilized. In an alternative embodiment of the present invention the sliding cinch 3 is a nut. The nut includes a threaded hole traversing through its body which provides additional resistance against freely sliding along the length of the elastic band 1, an example is illustrated in FIG. 7. In other embodiments of the present invention, alternative devices and mechanism may be used for the sliding cinch 3 component including, but not limited to, rings, beads, and other style retaining loops.

Referring to FIG. 1 and FIG. 2, the present invention further comprises a plurality of friction protrusions 9. The plurality of friction protrusions 9 provides an additional thickness to the elastic band 1 at incremental lengths of the elastic body. The plurality of protrusions is distributed along the elastic band 1 with each of the plurality of friction protrusions 9 being adjacently connected to the elastic band 1, preferably to an outer surface 2 of the elastic band 1 as seen in FIG. 2. When the sliding cinch 3 is positioned at one of the plurality of friction protrusions 9, the increased thickness provides additional resistance for the sliding cinch 3 against translating across the length of the elastic band The plurality of friction protrusions 9 may be implemented in a variety of shapes and design, for aesthetic purposes. In the preferred embodiment of the present invention, the plurality of friction protrusions 9 comprises four lightning-shaped protrusions as seen in FIG. 7. In one embodiment, the plurality of friction protrusions 9 is implemented in the form of a company logo, company statement, and or advertisement.

Figure 8:
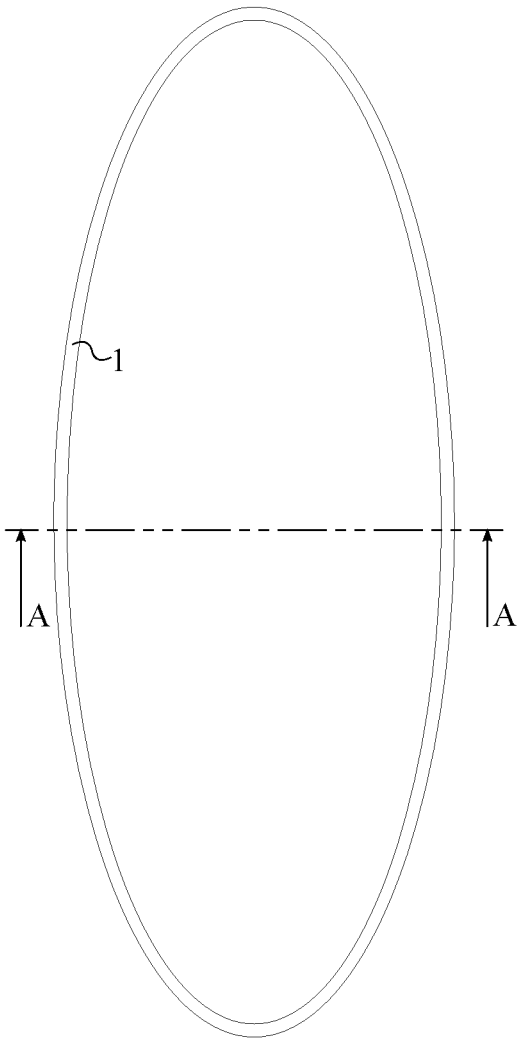
FIG. 8 is a front view of the elastic band.
Figure 9:
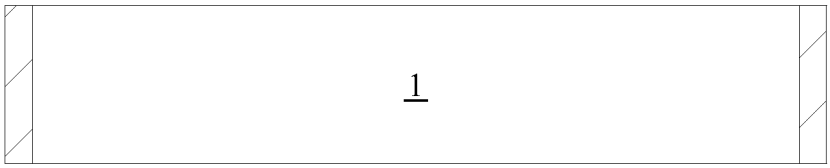
FIG. 9 is a sectional cut view taken about line A-A in FIG. 8.

In the preferred embodiment of the present invention, a cross-section of the elastic band 1 is a rectangular shape as seen in FIG. 8 and FIG. 9. The rectangular shape works best with the sliding cinch 3 and ensures that a significant amount of surface of the elastic band 1 engages the item being held by the present invention, thus providing a more secure grasp. Additionally, the elastic band 1 is preferably composed of a silicone rubber material. This is the most efficient material composition for the present invention as it provides adequate elasticity and surface grip for the elastic band 1. The elastic property allows the elastic band 1 to stretch around and conform to the outer contours of the item, increasing the surface being engaged with the item which provides additional securement. Although there have been many elastic cinch mechanisms to "tighten" different objects (such as hoodie draw strings, jacket waist tighteners, on gloves and bags, etc.), they are not designed to retain "items inside" and prevent slippage for carrying purposes. The present invention is unique in that it uses the silicone rubber material composition in conjunction with the sliding cinch 3 to securely hold items within the created loop of the elastic band 1. The silicone rubber material acts as a "grab hold" when cinched and put under tension to securely hold items inside the loop. Other elastic and cinch mechanism simply wrap around items to tighten and cannot adequately retain/hold said items. The present invention is not intended for tightening items, it grasps and "holds them inside" the created loop securely with little to no slippage because of the silicone rubber composition in combination with the sliding cinch mechanism 3. In alternative embodiments of the present invention, the elastic band 1 may be composed of alternative materials which provide the necessary elasticity.

In one embodiment of the present invention, the at least one sliding cinch 3 further comprises a first cinch 13 and a second cinch 14. Using more than one sliding cinch 3 creates additional separate loops in the elastic band 1, allowing the user to attach additional items via the additional separate loops. The first cinch 13 being positioned offset from the second cinch 14 with the elastic band 1 traversing through the first cinch 13 and the second cinch 14, thus creating three separate loops, seen in FIG. 7. One loop is used for the lanyard attachment mechanism 7 and the other two loops may be used for holding/securing two items.

Although the invention has been explained in relation to its preferred embodiment, it is to be understood that many other possible modifications and variations can be made without departing from the spirit and scope of the invention as hereinafter claimed.

What is claimed is:

1. A universal securement strap for personal items comprising:

an elastic band;

at least one sliding cinch comprising a constricting body and a strap-receiving hole defined by first opposing surfaces and second opposing surfaces;

a lanyard attachment mechanism coupled to the elastic band;

wherein the strap-receiving hole traverses through the constricting body;

wherein the elastic band is slidably positioned within the strap-receiving hole; and wherein only the first opposing surfaces have at least one friction rib positioned thereon.

2. The universal securement strap for personal items as claimed in claim 1, wherein the at least one sliding cinch comprises a first cinch and a second cinch, and wherein the first cinch is offset from the second cinch.

3. The universal securement strap for personal items as claimed in claim 1, wherein the at least one sliding cinch is a nut.

4. The universal securement strap for personal items as claimed in claim 1, further comprising a plurality of friction protrusions distributed along the elastic band.

5. The universal securement strap for personal items as claimed in claim 4, wherein each of the plurality of friction protrusions are connected to an outer surface of the elastic band.

6. The universal securement strap for personal items as claimed in claim 1, further comprising a key ring, wherein the elastic band is looped through the key ring; and wherein the lanyard attachment mechanism is coupled to the elastic band by the key ring.

7. The universal securement strap for personal items as claimed in claim 1, wherein the lanyard attachment mechanism is a crab claw.

8. The universal securement strap for personal items as claimed in claim 1, wherein the lanyard attachment mechanism is a quick-release keychain holder.

9. The universal securement strap for personal items as claimed in claim 1, wherein the lanyard attachment mechanism is a carabiner.

10. The universal securement strap for personal items as claimed in claim 1, wherein the elastic band is composed of a silicone rubber material.

11. A universal securement strap for personal items comprising:

an elastic band;

at least one sliding cinch comprising a constricting body and a strap-receiving hole that transverses through the constricting body having an inner surface defined by first opposing surfaces and second opposing surfaces;

at least one protrusion extending from only the first opposing surfaces; and wherein the elastic band is slidably positioned within the strap-receiving hole.

12. The universal securement strap for personal items as claimed in claim 11, wherein the at least one sliding cinch comprising a first cinch and a second cinch; and the first cinch is offset from the second cinch.

13. The universal securement strap for personal items as claimed in claim 11, wherein the at least one sliding cinch is a nut.

14. The universal securement strap for personal items as claimed in claim 11, further comprising a plurality of friction protrusions distributed along the elastic band and connected to an outer surface of the elastic band.

15. The universal securement strap for personal items as claimed in claim 11, wherein the elastic band is looped through a key ring; and wherein a lanyard attachment mechanism is coupled to the elastic band by the key ring.

16. The universal securement strap for personal items as claimed in claim 15, wherein the lanyard attachment mechanism is a crab claw.

17. A universal securement strap for personal items comprising:

an elastic band;

at least one sliding cinch having a constricting body and a strap-receiving hole that transverses through the constricting body;

wherein the elastic band is slidably positioned within the strap-receiving hole;

a plurality of friction ribs positioned within the strap-receiving hole located on an inner surface thereof defined by first opposing surfaces and second opposing surfaces;

wherein the elastic band is positioned within the at least one sliding cinch; and wherein each of the plurality of friction ribs is a half-circular extrusion that spans a length of the at least one sliding cinch.

* * * * *